US006817400B2

(12) United States Patent
Corey et al.

(10) Patent No.: US 6,817,400 B2
(45) Date of Patent: Nov. 16, 2004

(54) METHOD FOR MANUFACTURING CELLS OF A CELLULAR WINDOW COVERING

(75) Inventors: John A. Corey, Melrose, NY (US); Richard D. Watkins, Lake Luzerne, NY (US)

(73) Assignee: Comfortex Corporation, Watervliet, NY (US)

( * ) Notice: Subject to any disclaimer, the term of this patent is extended or adjusted under 35 U.S.C. 154(b) by 13 days.

(21) Appl. No.: 10/264,478

(22) Filed: Oct. 3, 2002

(65) Prior Publication Data

US 2003/0188835 A1 Oct. 9, 2003

Related U.S. Application Data

(60) Provisional application No. 60/369,996, filed on Apr. 3, 2002.

(51) Int. Cl.[7] ..... A47H 5/00
(52) U.S. Cl. ..... 160/84.05
(58) Field of Search ..... 160/84.05, 84.04, 160/84.06, 348, 405; 428/116, 118

(56) References Cited

U.S. PATENT DOCUMENTS

| | | | | |
|---|---|---|---|---|
| 2,786,521 A | | 3/1957 | Evans | |
| 4,450,027 A | | 5/1984 | Colson | |
| 4,884,612 A | * | 12/1989 | Schnebly et al. | 160/84.04 |
| 5,002,628 A | * | 3/1991 | Schnebly | 156/379 |
| 5,670,000 A | * | 9/1997 | Colson et al. | 156/197 |
| 5,680,891 A | * | 10/1997 | Prince | 160/84.05 |
| 5,691,031 A | * | 11/1997 | Swiszcz et al. | 428/116 |
| 5,733,632 A | | 3/1998 | Marusak | |
| 5,791,390 A | | 8/1998 | Watanabe | |
| 5,837,084 A | * | 11/1998 | Barss | 160/84.05 |
| 5,918,655 A | | 7/1999 | Corey | |
| 6,006,812 A | | 12/1999 | Corey | |
| 6,164,363 A | * | 12/2000 | Colson et al. | 160/84.05 |
| 6,206,075 B1 | | 3/2001 | Prince et al. | |
| 6,461,464 B1 | * | 10/2002 | Swiszcz | 156/221 |

FOREIGN PATENT DOCUMENTS

DE 35 29 418 C A1 4/1987

OTHER PUBLICATIONS

International Search Report No. PCT/US02/41375 dated Sep. 19, 2003.
International Search Report No. PCT/US02/41375 dated May 8, 2003.

* cited by examiner

*Primary Examiner*—David Purol
(74) *Attorney, Agent, or Firm*—Rader, Fishman & Grauer PLLC

(57) ABSTRACT

A cell and method of manufacturing a cell for a multi-cell window covering is disclosed. The method includes the steps of providing a flexible material, stiffening a portion of the flexible material, and creating at least one control engagement formation and at least one control clearance formation in axially extending sections of the stiffened flexible material that will become an upper portion and a lower portion of the cell. The method is further defined by folding the flexible material to create a closed element and securing the flexible material to itself to maintain the shape of the closed element.

7 Claims, 5 Drawing Sheets

METHOD FOR MANUFACTURING CELLS OF A CELLULAR WINDOW COVERING

RELATED APPLICATIONS

This application claims priority to U.S. provisional application 60/369,996 filed on Apr. 3, 2002, which is incorporated by reference in its entirety.

BACKGROUND OF THE INVENTION

1. Field of the Invention

The present invention generally relates to window coverings and treatments that include a plurality of individual cells that are variably adjustable between a collapsed position and an expanded position. More specifically, the present invention relates to the cells of a multi-cell window covering and a method for manufacturing the cells of a multi-cell window covering.

2. Description of the Related Art

Partly in response to the limitations inherent in traditional window coverings like venetian blinds, fresh window coverings and treatments, such as multi-cellular shades, were developed and welcomed by consumers. In the broad sense, a cellular shade is a window covering having a plurality of cells arranged adjacent to one another. The adjacent cells are bonded at their edges to form a complete sheet for the window covering. These multi-cellular shades provide significant insulating value, uniform light diffusion and a desirable aesthetic presentation, but they typically have no view-through capability. Unlike traditional venetian blinds, which provide easy modulatable view-through and light control by simply adjusting the orientation of the horizontally disposed slats or vanes, traditional multi-cellular shades are not capable of separating the plurality of cells, thus preventing a view-through option. Therefore, in order for a person to see through a window that is outfitted with a traditional multi-cellular shade, it is necessary to collectively raise and gather the plurality of cells, i.e., raise the entire window covering. However, raising the whole cellular window shade is laborious and time consuming.

In light of the advantages of venetian blind and multi-cellular window shades, a hybrid window covering was developed that provides the characteristics of both a venetian blind and a multi-cellular window covering. This hybrid window covering includes a plurality of cells arranged parallel to one another. Each cell has at least one side, and a joint that unites adjacent sides of each cell. The adjacent sides are pivotable about the joint such that each cell is variably adjustable between a collapsed position and an expanded position. By collapsing and expanding the cells, the window covering can achieve adjustable light-control, modulatable view-through, light diffusion, and excellent insulation value, all in an aesthetically pleasing design.

Included in this hybrid window covering is a means for variably adjusting the cells between the collapsed position, where adjacent cells are separated, and the expanded position, where adjacent cells contact one another. The adjustment means typically includes a pair of cords that engage and actuate the cells between the collapsed and expanded positions. Due to the structure of the cells, the relative position of the cords in each pair is not fore-and-aft (i.e., perpendicular to the plane of the window covering), as in a conventional venetian blind, but rather is parallel to the plane of the window covering for central, balanced lifting and lowering of the upper and lower portions of each cell. A series of beads or other suitable attachment elements are secured to the cords and are engaged with one or more surfaces of the cells during manufacture.

FIG. 1 of the drawings illustrates an exemplary window treatment employing the cell and cord arrangement described above. Note that in location "A," the upper surface of the cell includes a relatively small bead-engaging aperture aligned vertically with a larger cord clearance aperture on the lower surface of the cell. Alternatively, at location "B," the relatively small bead-engaging aperture is located on the lower surface of the cell and the larger cord-clearance aperture is located on the upper surface of the cell. Manufacturing alternating apertures on the upper and lower surfaces of a pre-manufactured, multi-surface cell is generally impractical, as it would require a separate manufacturing operation on the upper and lower surfaces of the cell. The difference in aperture size alone, regardless of the orientation between dissimilar apertures, renders their formation difficult with conventional punch tooling. In such a manufacturing operation, custom tooling is required to make a two-stage cut in the cell. Additionally, the scrap material from the punched upper aperture is likely to be retained in the cell, having no sufficiently sized hole in the lower surface of the cell to drop through.

SUMMARY OF THE INVENTION

A cell and method of manufacturing a cell for a multi-cell window covering is disclosed. The method begins with the step of providing a flexible material defined as an elongated member having axial and transverse directions. A portion of the flexible material is then stiffened to create at least one axially extending flexible junction. At least one control engagement formation and at least one control clearance formation are then created in axially extending sections of the stiffened flexible material that will become an upper portion and a lower portion of the cell. The flexible material is then folded to create a closed element and the flexible material is secured to itself to maintain the shape of the closed element.

The method of the present invention enables the manufacture of expandable and collapsible cells for a window covering, using common raw materials. The proposed method uses relatively inexpensive tooling to produce cells having distinct features in the upper and lower surfaces of the cells. The ability to create distinct features in the top and bottom surfaces of the cells enables the use of cords that selectively engage either the upper or lower portions of the cells at predetermined locations.

Various additional aspects of this invention will become apparent to those skilled in the art from the following detailed description of the preferred embodiments, when read in light of the accompanying drawings.

DESCRIPTION OF THE PREFERRED EMBODIMENTS

Figure 1:
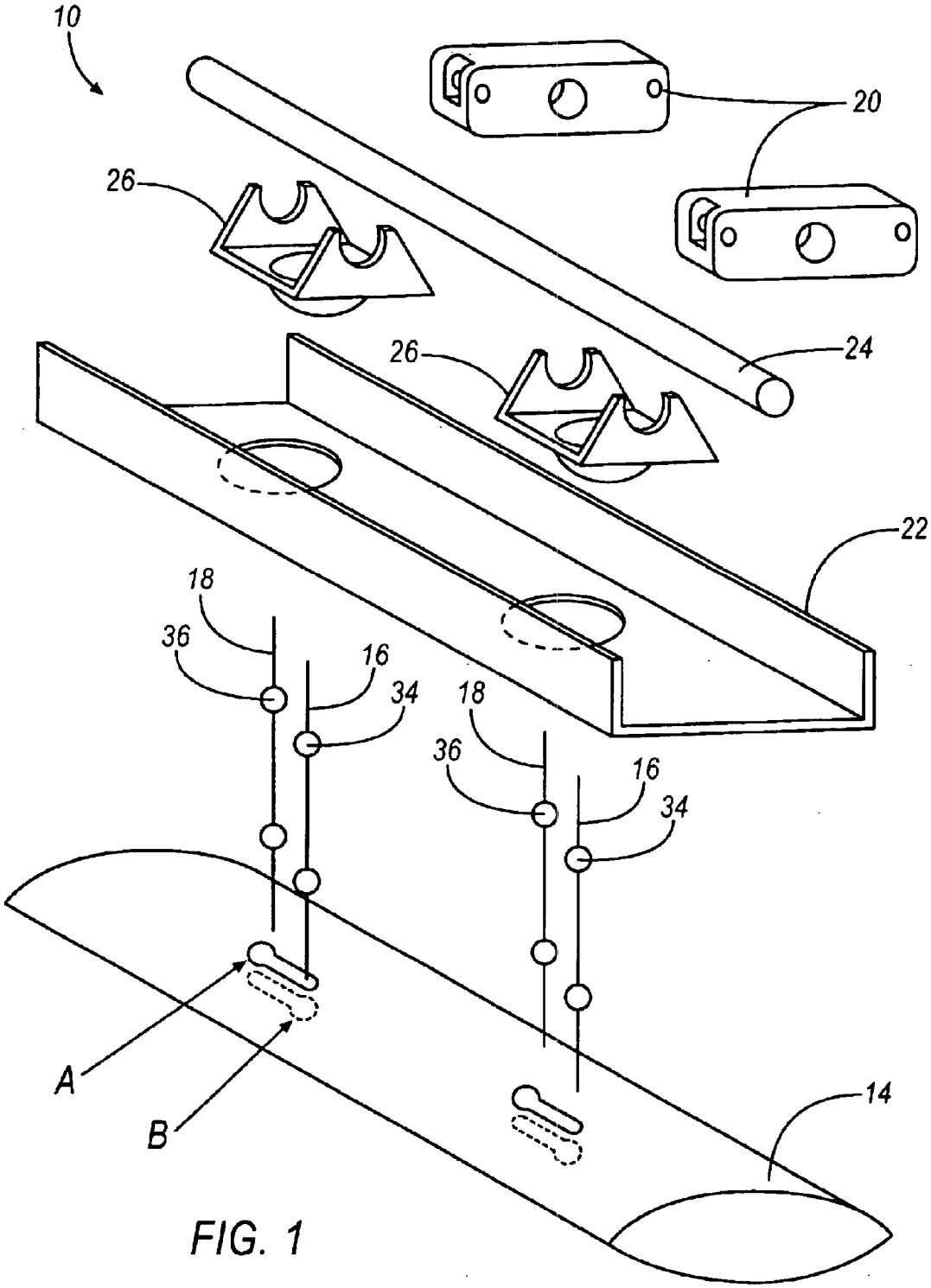
FIG. 1 is an exploded perspective view showing a portion of a window covering employing a plurality of cells manufactured according to the principles of the present invention.
Figure 3:
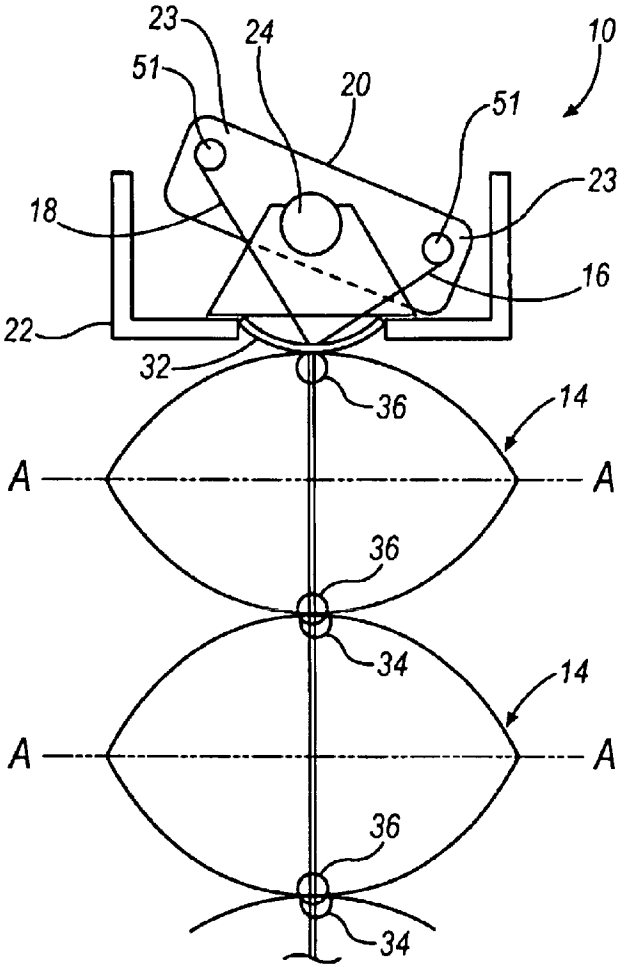
FIG. 3 is a side view of the window covering of FIG. 2, wherein the cells are arranged in a closed (expanded) position.
Figure 2:
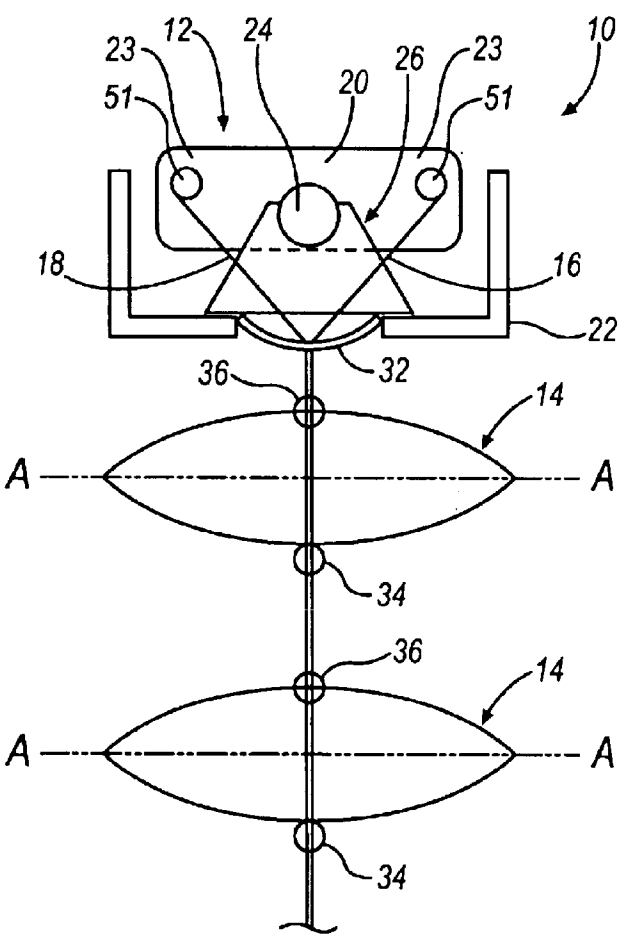
FIG. 2 is a side view of a window covering employing a plurality of cells manufactured according to the principles of the present invention, wherein a plurality of cells are arranged in an open (collapsed) position.

Referring now to the drawings, the preferred embodiments of the present invention are described in detail. Referring to FIGS. 1–3, an exemplary window covering 10 is shown within which an actuator device 12 is employed for controlling the light transmitting properties of window covering 10. Window covering 10 preferably includes a plurality of elongated cells 14, all of which are preferably arranged parallel to one another. Each cell 14 is adapted to be expanded and collapsed so as to provide variable light control and see-through capability for window covering 10. FIG. 3 depicts cells 14 in the expanded position, wherein adjacent cells 14 are in contact with one another, while FIG. 2 depicts cells 14 in a partly collapsed position, wherein adjacent cells 14 are separated from one another. The design and configuration of window covering 10 is by way of example only and is not intended to limit the scope of the invention as claimed. Accordingly, the components of the exemplary window covering 10, more particularly actuator device 12, can be arranged and designed in a wide variety of different configurations.

In order to achieve the collapsibility and expandability of cells 14, a cooperating pair of cords, i.e., a first cord 16 and a second cord 18, are employed in actuator device 12. As illustrated in FIG. 1, it is contemplated that a plurality of cord pairs could be disposed along the length of cells 14, the number of pairs employed generally depending on the width of window covering 10. At their upper extreme, cords 16 and 18 are secured to an actuator mechanism that is housed in a head-rail 22. In the embodiment illustrated in FIGS. 1–3, the actuator mechanism is a rotatable member 20 that includes a pair of integrally formed arms 23 to which cords 16, 18 are attached, but is not intended to be limited thereto. As will be described in further detail below, rotatable member 20 can be rotated in a direction that causes first cord 16 to move upward and second cord 18 to simultaneously move downward, and vice versa.

In order to adjust the shape of each cell 14, first cord 16 is adapted to support the lower portion of each cell 14 and second cord 18 is adapted to support the upper portion of each cell 14. By raising and lowering first cord 16 and second cord 18, each cell 14 can be expanded (see FIG. 3) or collapsed (see FIG. 2), without substantially lifting or lowering the weight of cells 14.

To support the lower portion of each cell 14, first cord 16 includes a plurality of elements 34 positioned along its length. Elements 34 are preferably spaced equally apart, such as in a bead chain, and each element 34 is adapted to abut an outer surface of the lower portion of a corresponding cell 14. When first cord 16 is raised, each element 34 presses upwardly against and lifts the lower portion of its associated cell 14. This lifting action results in the collapsing of each cell 14, as illustrated in FIG. 2. Collapse of each cell 14 is further facilitated by the lowering of second cord 18 (as described below), which occurs simultaneously with the raising of first cord 16 due to the pivotal movement of rotatable member 20. In the fully expanded condition of each cell 14 (as shown in FIG. 3), elements 34 drop through an enlarged aperture in the next lower cell, so as not to interfere with the desired face-to-face contact between adjacent cells 14 in the fully closed or view-blocking condition of cells 14.

Figure 4:
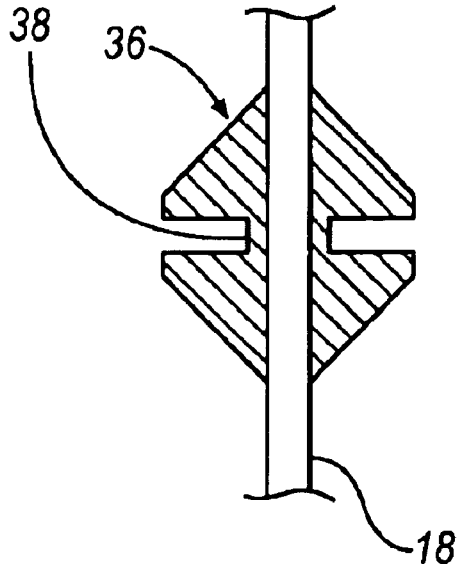
FIG. 4 is a cross-sectional view of a cord element and cord for use in expanding and collapsing the cells of a window covering.
Figure 5:
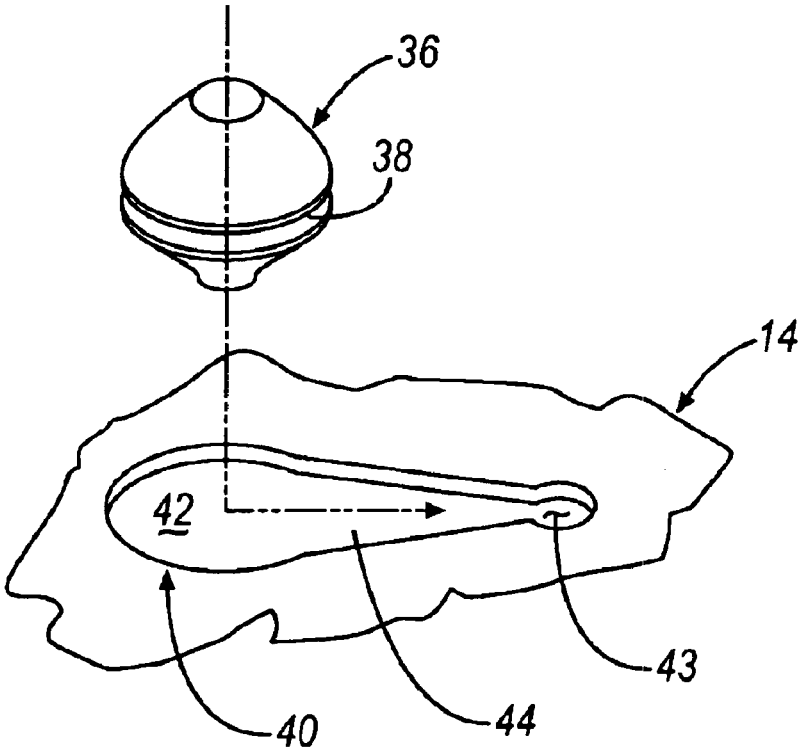
FIG. 5 is perspective view showing the cord element of FIG. 4 prior to engagement with an opening in a cell.

Similarly, second cord 18 includes a plurality of elements 36 positioned along its length. Each element 36 serves the function of providing support to the upper portion of a corresponding cell 14. As illustrated in FIGS. 4 and 5, elements 36 are preferably formed like small spools having a slot 38 that is slightly larger than the wall thickness of a mating cell 14. The outer surfaces of elements 36 are preferably conical to facilitate entry into an opening 40 in cell 14. The above-described structure of element 36 is not intended to be limited thereto, but may include other configurations such as clips, knots, loops and the like.

Referring to FIG. 5, opening 40 includes a first portion 42 that is large enough for elements 36 to be inserted into, and a second smaller portion 43 separated from first portion 42 by a tapered channel 44. Connecting elements 36 to cells 14 is accomplished by inserting element 36 into first portion 42 of opening 40 and subsequently sliding element 36 into second portion 43. Although not required, connecting elements 36 with the upper portion of each cell 14 at portions 43 advantageously reduces the tendency of cells 14 to flutter when collapsed or nearly collapsed.

Referring again to FIG. 2, each element 36 is used to support each cell 14 from the upper portion thereof. Therefore, when second cord 18 is raised along its longitudinal axis, each engaged element 36 supports each cell 14 from the upper portion thereof, wherein each cell 14 tends to "hang" from its engaged element 36. By raising cord 18, each cell 14 is suspended from its upper portion, while the simultaneous lowering of lift cord 16 and associated elements 34 allows the lower portion to move downwardly, thereby resulting in the expansion of cells 14.

Because the operative plane of cooperating cords 16 and 18 is substantially parallel with the plane of window covering 10, the expansion of cells 14 is effected by the relative raising of hang cord 18 and lowering of first cord 16 without significant fore-and-aft rotation or tilting of any cell 14 (as opposed to the case of intended tilting in conventional venetian blinds). In achieving the collapsibility and expandability of cells 14, it is essential that the ratio of the stiffness of each cell juncture to the weight of each cell 14 be selected so as to facilitate cell expandability and collapsibility. More specifically, the stiffness to weight ratio should be such that when the cells are supported from the upper portion, the weight of each cell 14 is sufficient to open the cell, and when cells 14 are supported from the lower portion, the stiffness of each cell juncture must be low enough so as to facilitate the collapsing of the cell. Accordingly, expansion of cells 14 is gravity-driven, requiring that second cord 18 regulate the expansion of cells 14, not force it.

Figure 6:
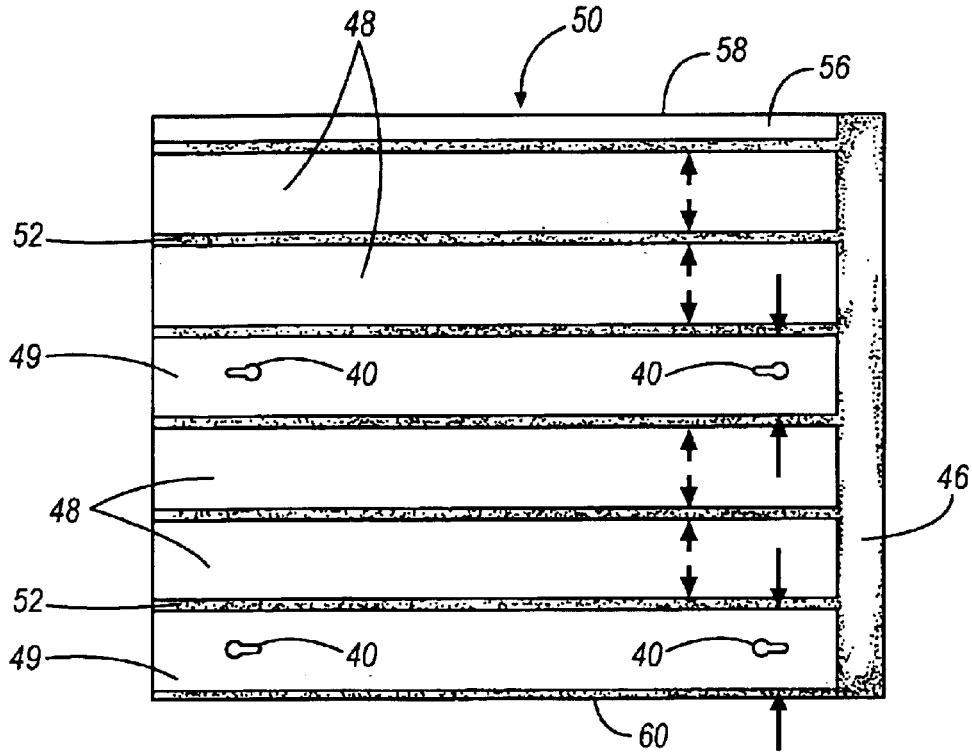
FIG. 6 is a plan view of a laminate prior to folding the laminate into a cell.

As illustrated in FIG. 6, a single cell 14, according to an embodiment of the present invention, is fabricated from a strip of a flexible material 46, such as a woven fabric. In a first manufacturing step, flexible material 46 is stiffened, such as by applying a curable stiffening compound to flexible material 46, or by laminating flexible material 46 with at least one stiffening member 48, such as, for example, a narrow strip of plastic film, stiffened fabric or metal ribbon.

In an exemplary embodiment of the present invention, flexible material 46 is laminated with at least two stiffening members 48, each spaced a predetermined distance apart, to form a laminate 50. Optionally, for aesthetic reasons, at least one of stiffening members 48 may be colored prior to laminating flexible material 46. The colored stiffening member(s) 48 is secured to flexible material 46 in an area that will be visible from within a room where the window covering is extended. Because the flexible material 46 selected may be translucent, the colored stiffening member (s) is visible through the material, permitting cells 14 of the window covering to match the decor of the room.

Figure 7:
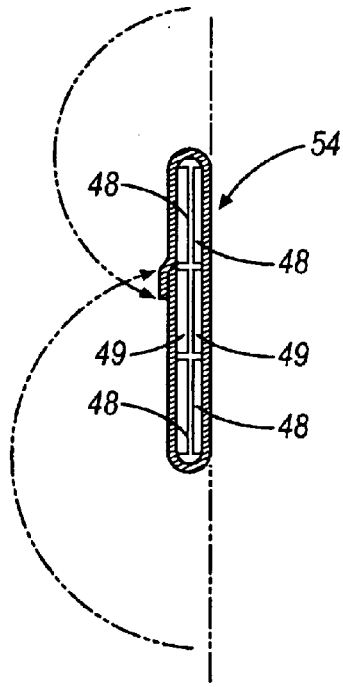
FIG. 7 is a side view of the laminate of FIG. 6 after folding the laminate into a cell.

Preferably, for reasons that will be explained below, the stiffening members that help form the upper and lower portions of cells 14, depicted as stiffening members 49 in FIG. 6, are a substantially rigid, yet formable material, such as metal. The gaps 52 provided between stiffening members 48, 49 permit flexible material 46 to act as a living hinge, allowing laminate 50 to be folded into a multisided tubular element 54. A closure seal 56, such as an adhesive or double sided tape, is provided between opposing edges 58, 60 of laminate 50 to retain tubular element 54 in tubular form. The joint between edges 58, 60 may be created as an overlapping joint, as illustrated in FIG. 7 or, alternatively, a butt-type joint (not shown).

Figure 8:
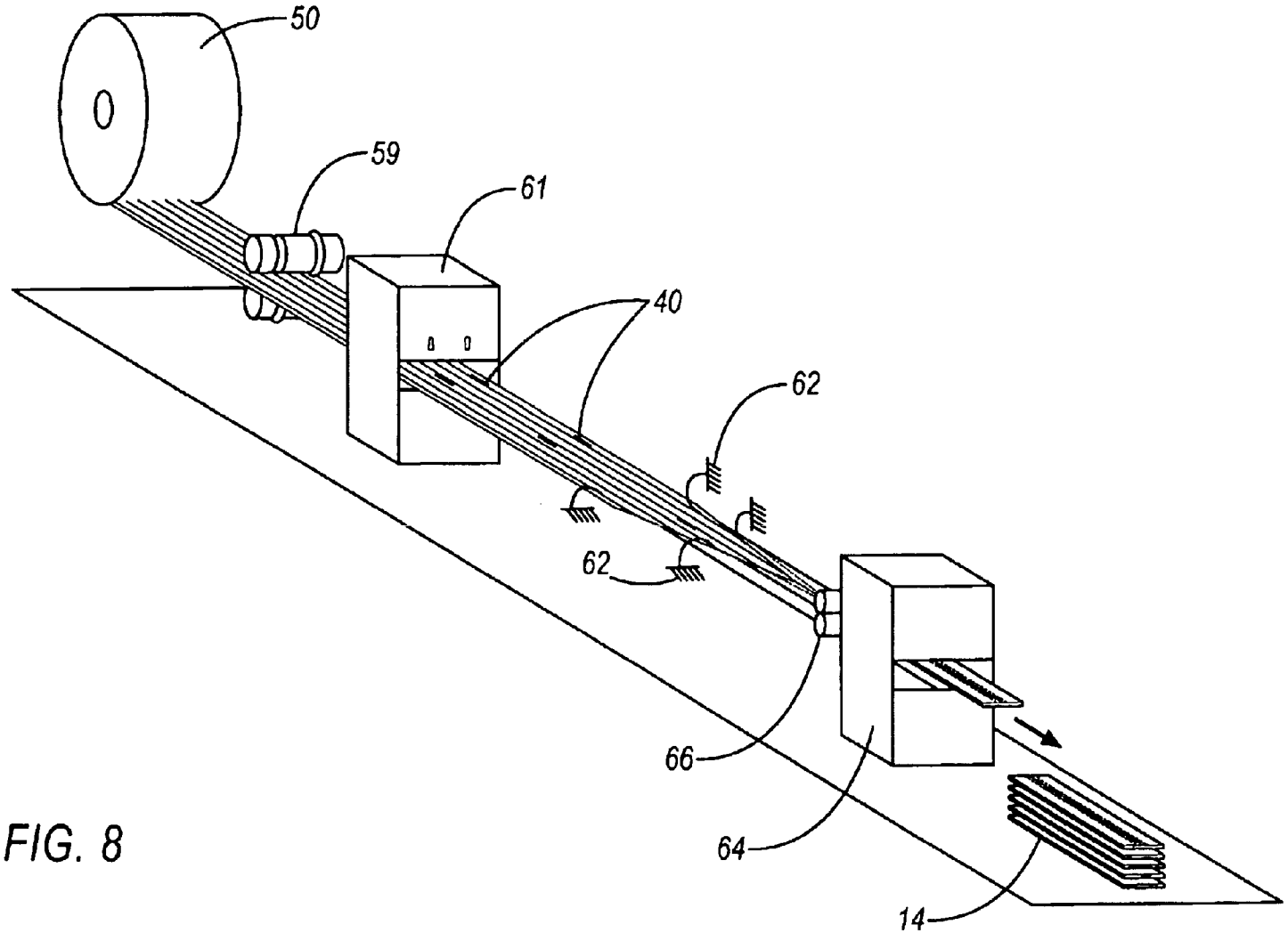
FIG. 8 is a simplified perspective view of an exemplary manufacturing line for manufacturing the cells of FIGS. 6 and 7.

In the process of manufacturing tubular element 54, it is desirable to maximize the longitudinal bending stiffness of laminate 50 to minimize the number of pairs of support cords 16, 18 needed to support cells 14 in window covering 10. Referring to FIG. 8, to increase the bending stiffness of laminate 50, stiffening members 49 are roll-formed or otherwise processed by a forming device 59 to give stiffening members 49 a curved, transverse cross-sectional shape (not illustrated). Forming the metal stiffening members 49 in this manner increases their effective section modulus, thereby increasing the longitudinal bending stiffness of laminate 50 as a whole. Alternatively, stiffening members 49 may be formed with a slight curve prior to laminating flexible material 46, particularly when stiffening members 49 are made from materials other than metal.

Prior to closing cell 14, stiffening members 49 are punched with a series of openings 40 by a punching tool 61. The spacing between openings 40 is generally a function of the bending stiffness of cells 14 and the relative vertical position of cords 16, 18. Because the portions of laminate 50 that will later become aligned at each location in top and bottom arrangement are, at this step, side-by-side transverse to the length of laminate 50, the punching operation can be accomplished simultaneously with one tool for both top and bottom openings 40. Alternatively, openings 40 may be created in laminate 50 by slitting, stitching or otherwise forming an engagement feature in laminate 50 for receiving elements 34, 36 or allowing passage of cords 16, 18. In addition, punching of adjacent openings 40 can also be achieved either simultaneously or in timed sequence with multiple punching tools, instead of the single punching tool described above.

The punched laminate 50 is then moved over a series of guides 62 that fold laminate 50 along at least two predetermined hinge lines, bringing the upper and lower surfaces of laminate 50 into an over-and-under position, as shown in FIG. 8. Closure seal 56 is then adhered to opposite edges of laminate 50, in an overlapping manner, to form the closed element 54. The cross-sectional profile of closed element 54 and finished cells 14 are not limited to the profile shown in FIGS. 2 and 3. It will be appreciated that the method of the present invention may be used to manufacture cells having different cross-sectional profiles, including, but not limited to, the cells disclosed in U.S. Pat. No. 5,680,891 to Kendall Prince.

Referring still to FIG. 8, each closed element 54 is then directed through a shearing machine 64, which is continuously timed by a measurement of the position of laminate 50, so as to be in register with the position of the punched openings 40. The position of laminate 50 may be continuously determined, for example, by a conventional encoder on pulling rolls 66, which act to pull laminate 50 through the manufacturing line, or by other means known in the art. This shearing operation generates a plurality of cells 14 with regularly spaced openings 40, symmetrically located between the sheared ends of cells 14. Cells 14 may then be strung together with cords 16 and 18, as described above, and attached to the actuator mechanism in head-rail 22 to form window covering 10. Alternatively, closed element 54 may be sheared into discrete cells before punching, such as by using a set of substantially identical punches on a self-spacing pantograph linkage (none illustrated), to provide for substantially equal spacing of the punches between sheared ends.

The disclosed method enables the manufacture of expandable and collapsible cells for a window covering, using common raw materials. The proposed method uses relatively inexpensive and ordinary tooling to produce cells having distinct features in the upper and lower surfaces of the cells. The ability to create distinct features in the top and bottom surfaces of the cells enables the use of cords that selectively engage either the upper or lower portions of the cells at predetermined locations. Such selective engagement permits independent, but coordinated, control of the expansion and collapse of the cells in a cellular window covering.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. A cell for use in a multi-cell window covering comprising:

a flexible material defined as an elongated member having axial and transverse directions, a portion of the flexible material being stiffened to create at least one axially extending flexible junction, the flexible material having transversely opposed edges that are fixed together to form a closed hollow cell having upper and lower portions; and first engagement formation located in said upper portion of the cell and a second engagement formation located in said lower portion of the cell, said engagement formations being adapted to selectively engage first and second cell control elements, respectively, to control the cross-sectional shape of the cell, each of said engagement formations including a variable width opening into said cell, said opening including wider portions through which cell control elements can freely pass and narrower portions through which such cell control elements cannot pass, said wider portions of each of said first and second engagement formations being vertically aligned with said narrower portions of the other of said first and second engagement formations, respectively.

2. The cell of claim 1, wherein the flexible material is stiffened with a stiffening compound.

3. The cell of claim 1, wherein the flexible material is stiffened by laminating the flexible material with a stiffening member.

4. The cell of claim 3, wherein the stiffening member comprises one of a plastic film, a stiffened fabric and a metal ribbon.

5. The cell of claim 3, wherein the flexible material is translucent and the stiffening member is colored.

6. The cell of claim 1 wherein said first and second engagement formations are located in said stiffened portions of said cell.

7. The cell of claim 1 wherein said wider and narrower portions of each of said openings are axially spaced from each other.

* * * * *